US009356344B2

(12) United States Patent
Lim

(10) Patent No.: US 9,356,344 B2
(45) Date of Patent: May 31, 2016

(54) ANTENNA APPARATUS AND FEEDING STRUCTURE THEREOF

(71) Applicant: LG INNOTEK CO., LTD., Seoul (KR)

(72) Inventor: Dong Uk Lim, Seoul (KR)

(73) Assignee: LG Innotek Co., Ltd., Seoul (KR)

( * ) Notice: Subject to any disclaimer, the term of this patent is extended or adjusted under 35 U.S.C. 154(b) by 225 days.

(21) Appl. No.: 13/937,973

(22) Filed: Jul. 9, 2013

(65) Prior Publication Data

US 2014/0015722 A1 Jan. 16, 2014

(30) Foreign Application Priority Data

Jul. 12, 2012 (KR) ..... 10-2012-0076313

(51) Int. Cl.

| | |
|---|---|
| ***H01Q 9/04*** | (2006.01) |
| ***H01Q 1/50*** | (2006.01) |
| ***H01Q 9/42*** | (2006.01) |
| ***H01Q 5/364*** | (2015.01) |

(52) U.S. Cl.

CPC ..... *H01Q 1/50* (2013.01); *H01Q 5/364* (2015.01); *H01Q 9/0421* (2013.01); *H01Q 9/42* (2013.01)

(58) Field of Classification Search

CPC ..... H01Q 1/242; H01Q 1/243; H01Q 5/30; H01Q 5/314; H01Q 5/328; H01Q 9/0407; H01Q 9/0421

See application file for complete search history.

(56) References Cited

U.S. PATENT DOCUMENTS

| | | | | |
|---|---|---|---|---|
| 6,693,594 | B2 * | 2/2004 | Pankinaho et al. | 343/700 MS |
| 6,836,248 | B2 * | 12/2004 | Fukushima et al. | 343/700 MS |
| 7,142,162 | B2 * | 11/2006 | Taromaru | H01Q 3/44 343/702 |
| 2001/0035843 | A1 | 11/2001 | Boyle | |
| 2003/0006936 | A1 | 1/2003 | Aoyama et al. | |
| 2004/0233109 | A1 | 11/2004 | Ying et al. | |
| 2007/0069956 | A1 * | 3/2007 | Ozkar | H01Q 5/00 343/700 MS |
| 2008/0079642 | A1 | 4/2008 | Ishizuka et al. | |
| 2010/0060530 | A1 | 3/2010 | Shoji | |
| 2010/0141536 | A1 | 6/2010 | Zhang et al. | |
| 2011/0128200 | A1 | 6/2011 | Hossain et al. | |
| 2012/0009983 | A1 | 1/2012 | Mow et al. | |
| 2013/0194144 | A1 | 8/2013 | Lee | |

FOREIGN PATENT DOCUMENTS

| | | | |
|---|---|---|---|
| CN | 1381079 | A | 11/2002 |
| CN | 101273493 | A | 9/2008 |
| CN | 101308950 | A | 11/2008 |
| CN | 101714698 | A | 5/2010 |
| JP | 2003-069330 | A | 3/2003 |
| JP | 2007-088975 | A | 4/2007 |
| JP | 2009-510901 | A | 3/2009 |
| JP | 2009-182793 | A | 8/2009 |
| JP | 2012-182632 | A | 9/2012 |
| KR | 10-2003-0066779 | A | 8/2003 |
| KR | 2003-0085000 | A | 11/2003 |
| KR | 10-2011-0019666 | A | 2/2011 |
| KR | 10-2011-0068246 | A | 6/2011 |
| WO | WO 2010/137061 | A1 | 12/2010 |

* cited by examiner

*Primary Examiner* — Sue A Purvis
*Assistant Examiner* — Patrick Holecek
(74) *Attorney, Agent, or Firm* — Birch, Stewart, Kolasch & Birch, LLP

(57) ABSTRACT

Embodiments provide connecting various circuits to which capacitive elements are connected to obtain an optimal capacitive reactance value needed in a resonance. Embodiments provide a capacitance value of an optimal capacitive reactance needed in a resonance by connecting a plurality of capacitive elements to a conductive line connecting an emitter and a ground in series or connecting one or more capacitive elements in parallel/series.

3 Claims, 14 Drawing Sheets

ANTENNA APPARATUS AND FEEDING STRUCTURE THEREOF

CROSS-REFERENCE TO RELATED APPLICATIONS

The present application claims priority under 35 U.S.C. 119 and 35 U.S.C. 365 to Korean Patent Application No. 10-2012-0076313 (filed on Jul. 12, 2012), which is hereby incorporated by reference in its entirety.

BACKGROUND

The present disclosure relates to an apparatus for forming various circuits to be connected to a capacitive element and using a proper capacitive element value to obtain an optimal capacitive reactance value required in a resonance.

An antenna is a device receiving an RF signal in the air inside a terminal or transmitting a signal inside the terminal outwardly, which is an essential element of a wireless device for communication with the outside.

FIG. 1 is a configuration view illustrating an antenna 10 according to related art. Referring to FIG. 1, the antenna 10 includes a feeding part 11 and radiating bodies 12*a* and 12*b*. In the antenna 10, the feeding part 11 is connected to the radiating bodies 12*a* and 12*b* in series and a signal provided by the feeding part 11 is transmitted to the outside via the radiating bodies 12*a* and 12*b*.

In this case, the radiating bodies 12*a* and 12*b* may be grounds (not shown) of a wireless communication device or may be additional radiating bodies. On the other hand, one 12*a* may be an additional radiating body and another 12*b* may employ a ground body as a radiating body.

In case of the antenna 10 of FIG. 1, since an electric signal is directly provided from the feeding part 11 to the radiating bodies 12*a* and 12*b* by only using an electric method without an additional feeding structure, a performance thereof is lower than that of an antenna including a feeding structure.

FIG. 2 is a view illustrating an antenna 20 including a feeding structure according to related art.

Referring to FIG. 2, the antenna 20 includes a feeding part 21, radiating bodies 22*a* and 22*b*, and a conductive line 24 for forming a feeding loop 25.

In case of the antenna 20 of FIG. 2, since the feeding loop 25 is formed by using the conductive line 24, it is possible to perform feeding by magnetic coupling in addition to electric feeding, thereby providing more improved performance than the antenna 10 of FIG. 1, which does not include the feeding loop 25. However, though the antenna 20 includes the feeding loop 25, a performance thereof is decreased in a high frequency area. A detailed description thereof is as follows.

When an RF current provided from the feeding part 21 flows through the feeding loop 25, there is generated an equivalent magnetic current Im. The equivalent magnetic current Im is expressed as follows.

$$I_m l = j\omega\mu S I(\omega) \qquad \text{Equation (1)}$$

In Equation 1, j indicates an equivalent magnetic current having a length, ω indicates an angular frequency, μ indicates permeability, S indicates an area of a feeding loop, and I(ω) indicates an RF currrent provided from a feeding part.

The equivalent magnetic current Im generated in the feeding loop 25 may be considered as a magnetic flux generated in the feeding loop 25, and a relation between the magnetic flux generated in the feeding loop 25 and the equivalent magnetic current Im is expressed as follows.

$$I_m = -j\omega\psi \qquad \text{Equation (2)}$$

In Equation 2, ψ indicates a total sum of the magnetic flux generated in the feeding loop 25.

On the other hand, the total sum of the magnetic flux generated in the feeding loop 25 may be expressed as follows.

$$\begin{aligned}\psi &= \int \vec{B}\cdot d\vec{s} \approx B\cdot s \\ &= L\cdot I \\ &= L\frac{V}{R+j\omega L} \\ &\propto \frac{1}{\omega}\end{aligned} \qquad \text{Equation (3)}$$

According to Equation 3, it can be known that a total amount of the magnetic flux generated in the feeding loop 25 is reduced as a frequency of the RF current provided from the feeding part 21 increases.

That is, the reduction of the total amount of the magnetic flux generated in the feeding loop 25 means a reduction of the equivalent magnetic current Im. Accordingly, since the equivalent magnetic current Im is reduced at a high frequency and it is impossible to efficiently feed the RF signal to the radiating bodies 22*a* and 22*b*, the performance of the antenna 20 of FIG. 2 is decreased at the high frequency and a band thereof may become narrower.

On the other hand, in an antenna structure, it is standardized that capacitance value (0.3 to 1.5 pF) that is a low capacitive element is used in 1800 MHz or more and a high capacitance value (6 to 9 pF) is used in 960 MHz or less.

In this case, a product standardized as a low capacitance of 2 pF or less exists as a 0.1 pF unit and a product standardized as a high capacitance of 6 pF or more exists as a 1 pF unit.

However, since antennas are more sensitive than a standardized tolerance of a capacitance, a capacitance value that is not standardized is needed when forming a resonance at a desired frequency.

SUMMARY

Embodiments provide an antenna apparatus, in which a feeding structure has a resonance frequency with broadband characteristics.

According to the embodiment, there is provided an antenna apparatus including a radiating body, a feeding part for providing a signal for the radiating body, and a grounding part for grounding the radiating body and extended from the feeding part.

According to the embodiment, there is provided a feeding structure including a feeding part for providing a signal and a grounding part extended from the feeding part.

The details of one or more embodiments are set forth in the accompanying drawings and the description below. Other features will be apparent from the description and drawings, and from the claims.

DETAILED DESCRIPTION OF THE EMBODIMENTS

Hereinafter, there will be described an apparatus for an antenna resonance frequency according to an embodiment with reference to the attached drawings.

Terms used in the embodiments generally used now as possible are selected. However, there are terms arbitrarily selected by applicants in a particular case, the terms of which operation and meaning are disclosed in detail in a corresponding description. Accordingly, the terms should be understood from operation/meaning thereof instead of a simple designation thereof.

Also, "being linked", "being connected", or "being in contact with" indicates not only a case of being directly connected but also a case of one of being mechanically connected via another component, another medium, or another device, being electrically connected, and being wired/wireless connected.

Figure 1:
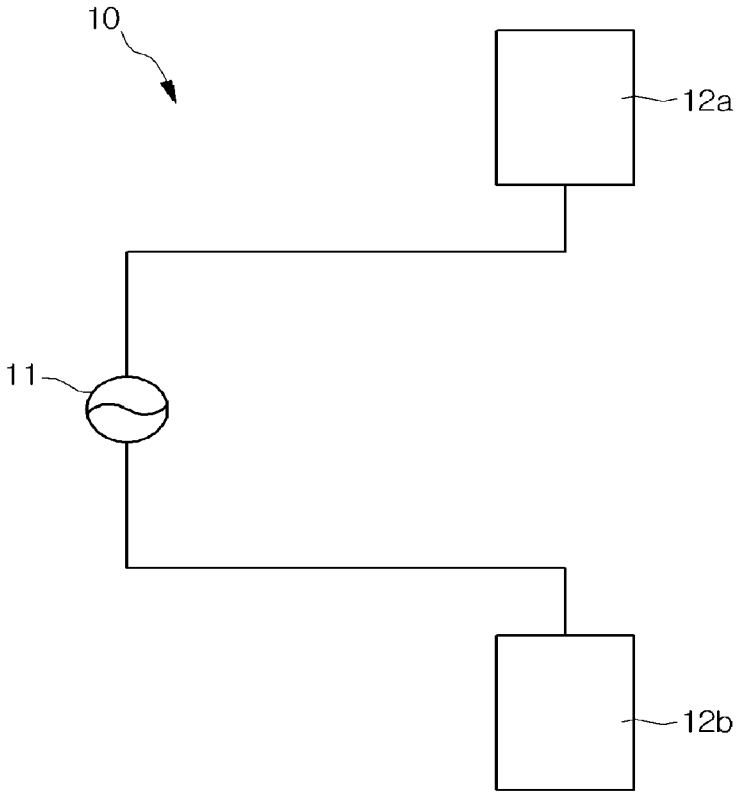
FIG.1 (RELATED ART)
FIG. 1 is a configuration view illustrating an antenna according to related art.
Figure 2:
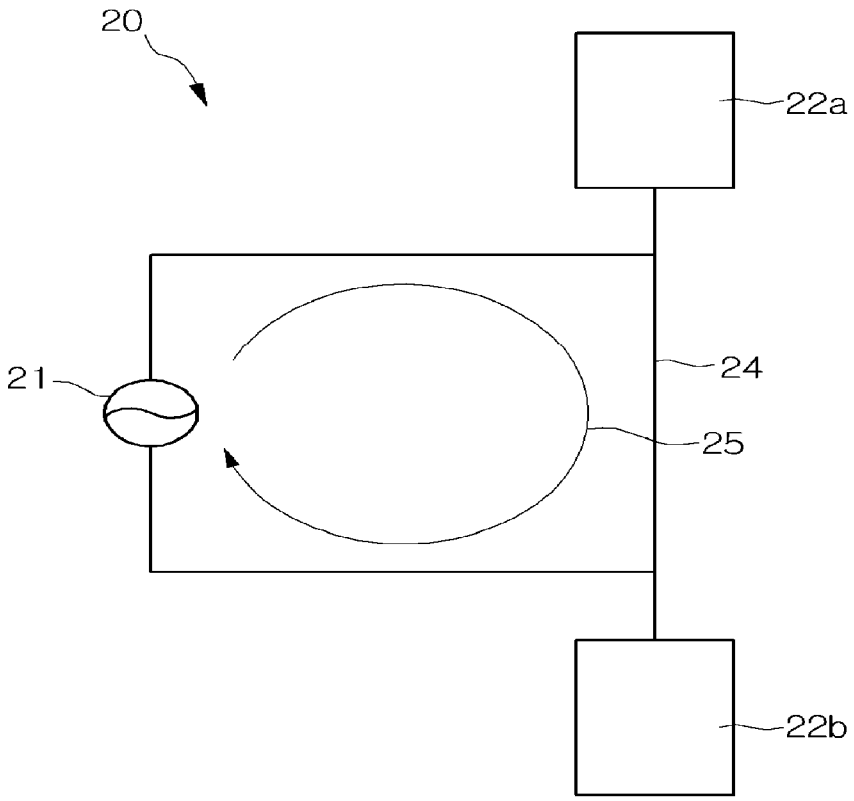
FIG.2 (RELATED ART)
FIG. 2 is a view illustrating an antenna including a feeding structure according to related art.
Figure 3:
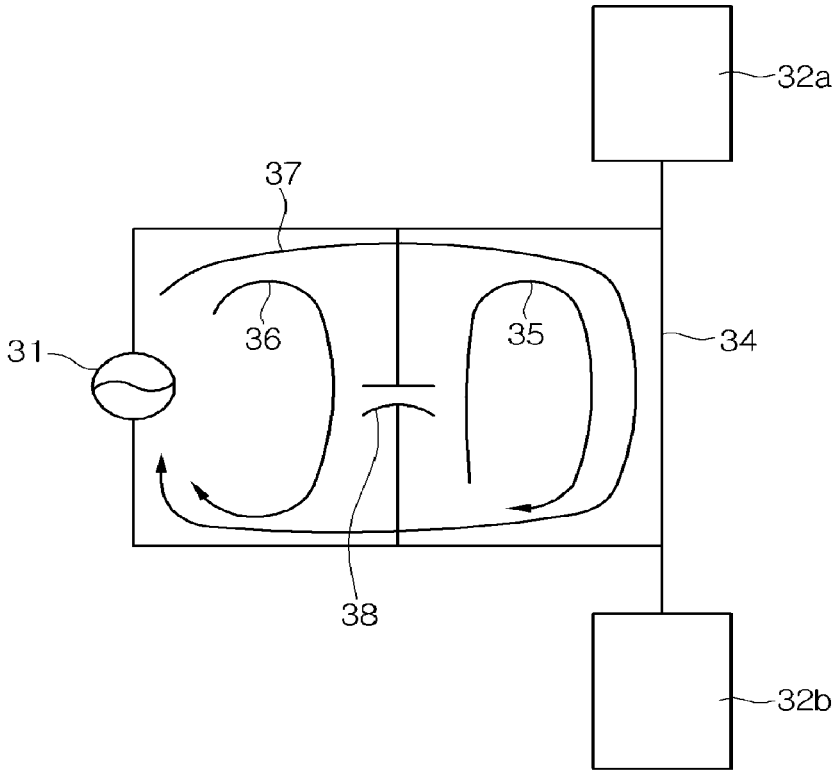
FIG. 3 is a view illustrating an antenna with a feeding structure as a description related to one embodiment.
Figure 4:
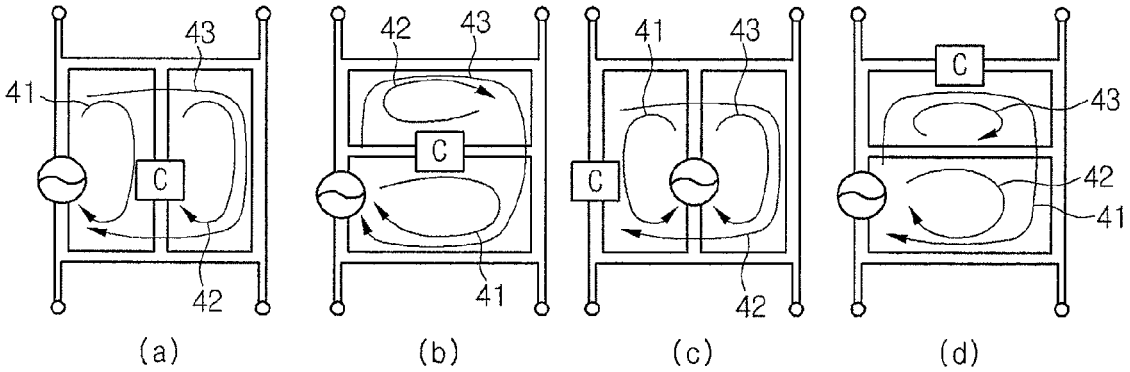
FIGS. 4A to 4D are views illustrating feeding structures according to one embodiment.

FIG. 3 is a view illustrating an antenna with a feeding structure as a description related to one embodiment.

As shown in FIG. 3, the antenna includes radiating bodies 32*a* and 32*b*, and a feeding structure for feeding a signal to the radiating bodies 32*a* and 32*b*. The feeding structure includes a feeding part 31, a resonance addition part and a conductive line 34. The conductive line 34 may include a grounding part. The resonance addition part includes a reactance device 38. The reactance device 38 comprises at least one of a capacitive device and an inductive device. The capacitive device may be a capacitor. The inductive device may be an inductor.

In the antenna, a first loop 36 is formed by the feeding part 31 and the resonance addition part, a second loop 35 is formed by the resonance addition part and the conductive line 34, and a third loop 37 is formed by the feeding part 31 and the conductive line 34.

There will be described the operation principle of the antenna of FIG. 3 as follows.

In a low frequency area, since an impedance of the first loop 36 increases, a current mainly flows toward the third loop 37 and a magnetic flux generated by the third loop 37 mainly excites the radiating bodies 32*a* and 32*b*.

Also, in a high frequency area, since an impedance of the third loop 37 increases, a current mainly flows toward the first loop 36 and a magnetic flux generated by the first loop 36 mainly excites the radiating bodies 32*a* and 32*b*.

On the other hand, in an intermediate frequency area, a resonance is generated due to an inductance (not shown) provided by the second loop 35 itself and a reactance provided by the reactance device 38 and a magnetic flux generated according to the resonance mainly excites the radiating bodies 32*a* and 32*b*.

As described above, the antenna according to the present embodiment includes a plurality of loops generating strong magnetic fluxes in different frequency areas, thereby performing broadband feeding.

A frequency where a resonance is generated may be expressed as follows.

$$f = \frac{1}{2\pi\sqrt{L_f C}} \qquad \text{Equation (4)}$$

In Equation 4, f indicates a resonant frequency, Lf indicates an inductance provided by a current loop, and C indicates a reactance of the reactance device 38.

On the other hand, the inductance provided by the current loop may be expressed as follows.

$$L_f \approx \mu \times \sqrt{S} \qquad \text{Equation (5)}$$

In Equation 5, μ indicates permeability and S indicates an area of a current loop.

Accordingly, areas of the loops 35 and 36 corresponding to current loops of a corresponding frequency band and a capacitance of the reactance device 38 are controlled, thereby determining the frequency where a resonance is generated.

Accordingly, when applying the feeding structure according to the present embodiment, not only broadband features can be provided but also a center frequency of a band can be controlled, thereby providing broadband features in a desired band.

On the other hand, when the reactance value is standardized in a general antenna structure as a low reactance value (0.3 to 1.5 pF) is used at 1800 MHz or more and a high reactance value (6 to 9 pF) is used at 960 MHz or less.

In this case, a product standardized as a low reactance of 2 pF or less exists as a 0.1 pF unit and a product standardized as a high reactance of 6 pF or more exists as a 1 pF unit.

However, since antenna structures are more sensitive than a standardized tolerance of a reactance device, a reactance value that is not standardized is needed when forming a resonance at a desired frequency.

Accordingly, it is possible to derive a reactance device value needed in a resonance by combining optimal reactance devices via performing one of 1) connecting a plurality of reactance devices in series, 2) connecting circuits including one or more reactance devices in parallel, and 3) a parallel connection by mixing 1) and 2).

FIGS. 4A to 4D are views illustrating feeding structures according to one embodiment. Referring to FIGS. 4A to 4D, though there are shown various shapes of feeding structures, all the feeding structures have features as follows.

That is, a resonance addition part may be disposed between a feeding part and a grounding part. Or, a feeding part may be disposed between a grounding part and a resonance addition part. There are formed a plurality of loops in which a first loop 41 that is a loop corresponding to a high frequency and includes a feeding part and a reactance device, a second loop 42 that is a loop corresponding to an intermediate frequency and includes the reactance device and a conductive line (or an inductive element) connecting both ends of the reactance device, and a third loop 43 that is a loop corresponding to a low frequency and include the feeding part and a conductive line (or an inductive element) connecting both ends of the feeding part.

Though there are shown cases without matching elements connected to feeding parts in FIGS. 4A to 4D, the feeding part may be connected to a matching element. In this case, the matching element is an integrated circuit (an inductor or a capacitor) having a reactance component and is connected to the feeding part in series or in parallel.

On the other hand, the second loop 42 corresponding to the intermediate frequency should satisfy a resonance condition at a desired frequency, in which an inductance needed in the resonance condition is provided by only a current loop or provided by the current loop and an integrated circuit element (an inductive element). In this case, the inductance provided by the current loop is determined by an area of the second loop 42. A total inductance provided by the current loop and the inductive element is as follows.

$$L_{total}=L_f+L_{lump} \qquad \text{Equation (6)}$$

In Equation 6, $L_{total}$ indicates a total inductance, $L_f$ indicates an inductance provided by a current loop, and $L_{lump}$ indicates an inductance provided by an inductive element, which can be checked via a test. Accordingly, since a resonance is generated when XL according to an inductive element is the same as XC according to a capacitive element, a capacitance for the resonance may be obtained.

Accordingly, when an inductance is provided by not only the current loop but also the integrated circuit element (the inductive element), Equation 4 related to a resonance frequency may be expressed as follows.

$$f=\frac{1}{2\pi\sqrt{L_{total}C}} \qquad \text{Equation (7)}$$

Figure 5A:
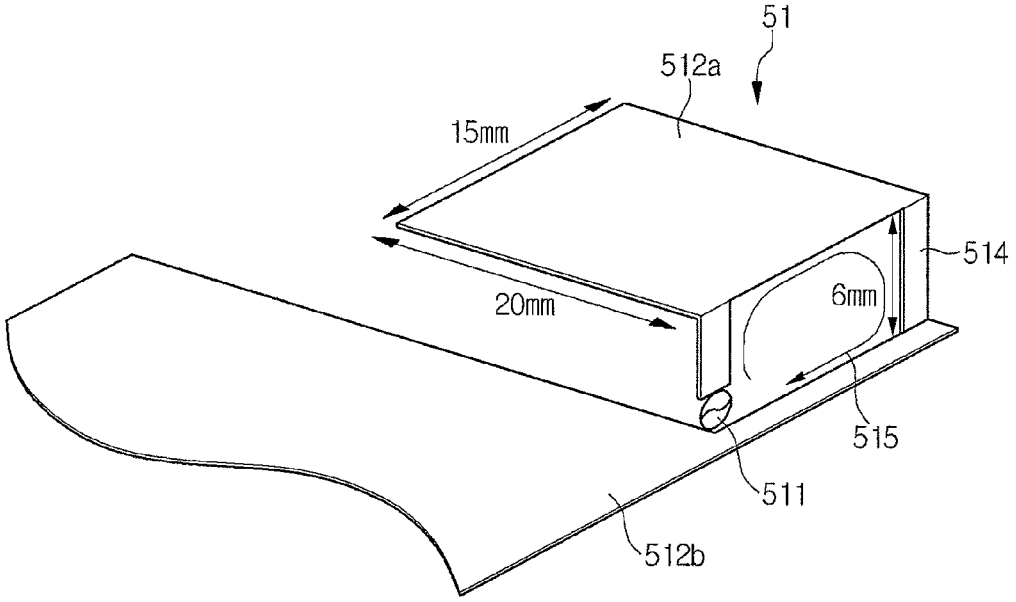
FIG. 5A is a view illustrating an example of an antenna with a feeding structure according to one embodiment.

FIG. 5A is a view illustrating an example of an antenna 51 with a feeding structure according to one embodiment.

The antenna 51 includes a radiating body 512*a*, a ground body 512*b* providing a ground potential and operating as a radiating body 512*a*, and a feeding structure. The feeding structure includes a feeding part 511 providing a signal to the radiating body 512*a* and a conductive line 514 forming a feeding loop 515 extended from the feeding part 511. The conductive line 514 is a grounding part. The grounding part is connected to the radiating body 512*a* and the ground body 512*b*, thereby grounding the radiating body 512*a* on the ground body 512*b*.

Figure 5B:
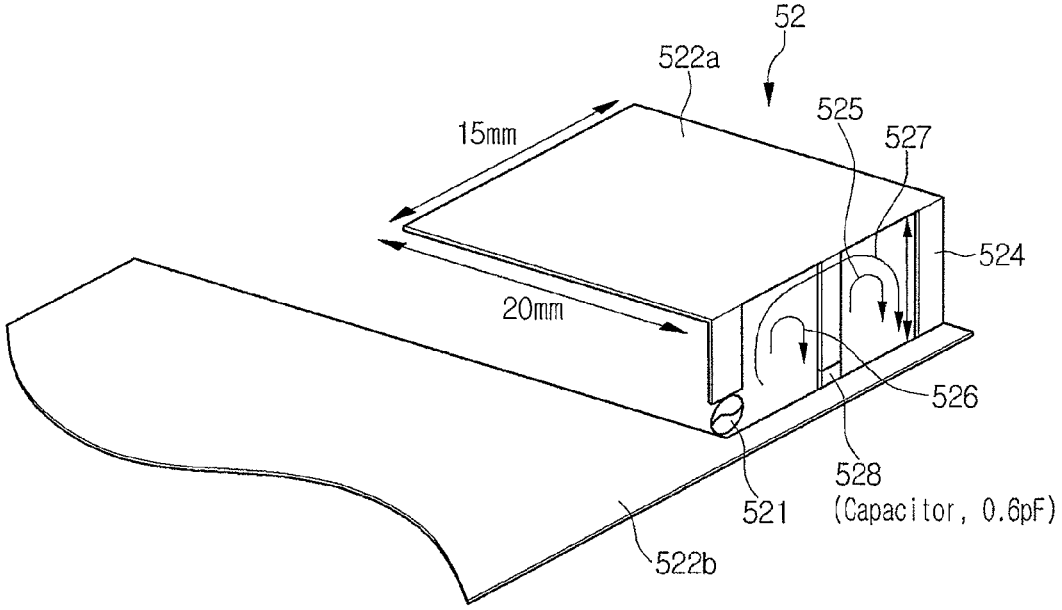
FIG. 5B is a view illustrating an antenna with a feeding structure according to another embodiment.

FIG. 5B is a view illustrating an antenna with a feeding structure according to another embodiment. The antenna 52 includes the feeding structure shown in FIG. 4A.

The antenna 52 includes a radiating body 522*a*, a ground body 522*b* not only providing a ground potential but also operating as a radiating body 522*a*, and a feeding structure. The feeding structure includes a feeding part 521, a resonance addition part, and a conductive line 524. The conductive line 524 may include a grounding part. The resonance addition part is connected to the ground body 522*b*. Further, the resonance addition part includes a reactance device 528. The reactance device 528 comprises at least one of a capacitive device and an inductive device. The capacitive device may be a capacitor. The inductive device may be an inductor.

In the antenna 52, a first loop 526 is formed by the feeding part 521 and the resonance addition part, a second loop 525 is formed by the resonance addition part and the conductive line 524, and a third loop 527 is formed by the feeding part 521 and the conductive line 524.

Controlling a resonance frequency by the antenna 52 according to the present embodiment may be performed as follows.

First, with respect to the antenna 20 shown in FIG. 5B, according to Equation 5, an inductance according to the second loop 525 is obtained as follows.

$$L_f \approx \mu\times\sqrt{S}=4\pi\times10^{-7}\times\sqrt{5\times6\times10^{-6}}=6.9\,\text{nH} \qquad \text{Equation (8)}$$

Also, according to Equation 4, a resonance frequency according to the second loop 525 is obtained as follows.

$$f_r=\frac{1}{2\pi\times\sqrt{0.6\times10^{-12}\times6.9\times10^{-9}}}=2.47\ \text{GHz} \qquad \text{Equation (9)}$$

Figure 6:
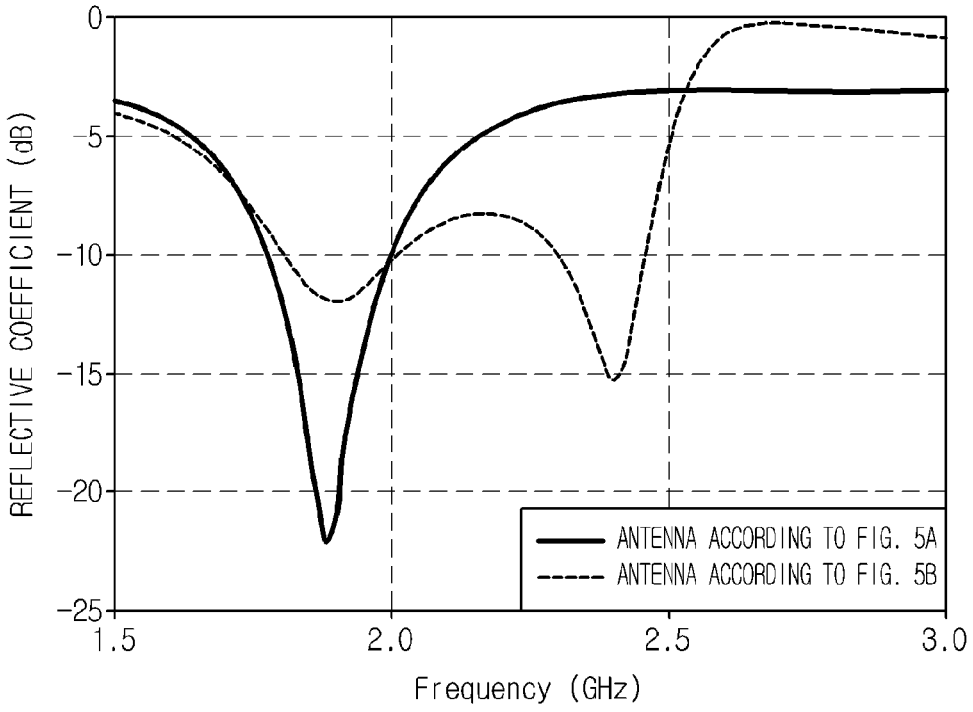
FIG. 6 is a view illustrating a result of comparing performance of the antenna according to FIG. 5A with that of the antenna according to FIG. 5B.

FIG. 6 is a view illustrating a result of comparing performance of the antenna 51 according to FIG. 5A with that of the antenna 52 according to FIG. 5B.

As shown in FIG. 6, it may be known that the antenna 52 of FIG. 5B has more broadband characteristics than the antenna of FIG. 5A. Also, it may be known that a resonance may actually occur around 2.47 GHz of a resonance frequency obtained by Equation 7.

Accordingly, it may be known that the antenna 52 including the feeding structure according to the present embodiment not only has broadband characteristics but also controls a resonance frequency if necessary, thereby easily designing an antenna with a desired band. That is, it is possible to design an antenna with a desired band by changing an area of a second loop and a capacitance of a capacitive element. Also, when an inductance generated in the area of the second loop is small, it is possible to design the antenna with a desired band by adding an inductive element to the second loop.

Figure 7:
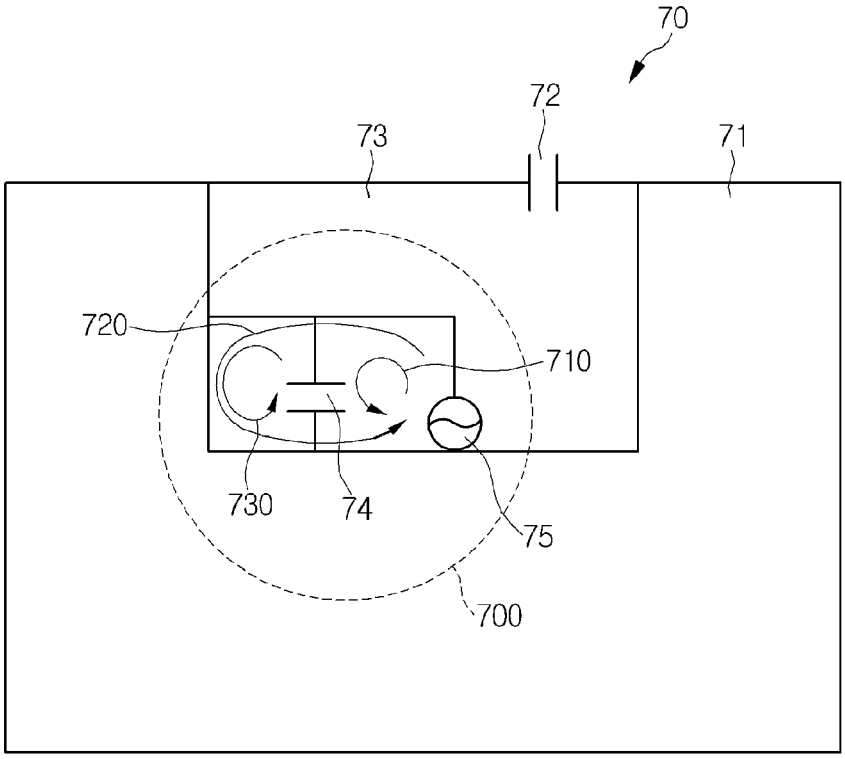
FIG. 7 is a view illustrating an antenna with a feeding structure according to still another embodiment.

FIG. 7 is a view illustrating an antenna with a feeding structure according to still another embodiment.

The antenna 70 includes a ground body 71 operating as a radiating body, a capacitor 72, a clearance 73 that is an area where the ground body 71 is removed, and a feeding structure 700 formed inside the clearance 73.

In the feeding structure 700, a first loop 710, a second loop 730, and a third loop 720 are formed. The first loop 710 is formed by a feeding part 75 and a resonance addition part having a reactance device 74. The second loop 730 is formed by the resonance addition part and a grounding part connected to the ground body 71. Also, the third loop 720 is formed the feeding part 75 and the grounding part.

Further, the third loop 720 is corresponded to a low frequency loop, the second loop 730 is corresponded to an intermediate frequency loop, and the first loop 710 is corresponded to a high frequency loop. Therefore, a resonance frequency of the antenna 70 is determined by an area of the first loop 710 and an area of the second loop 730, and a reactance of the reactance device 74.

Figure 8:
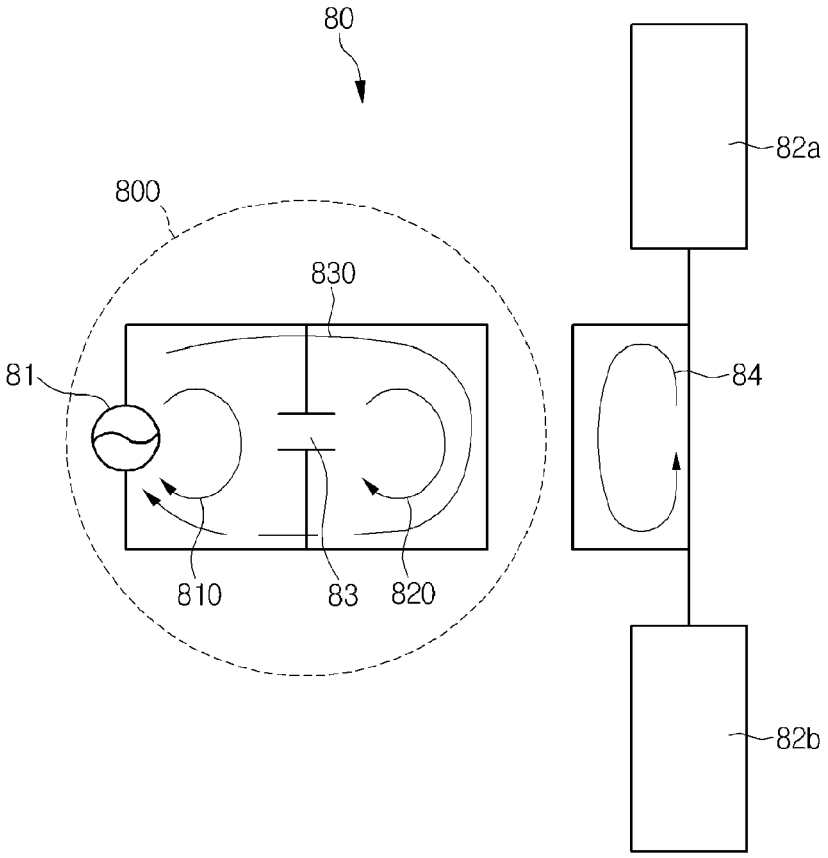
FIG. 8 is a view illustrating an antenna with a feeding structure according to a further embodiment.

FIG. 8 is a view illustrating an antenna 80 with a feeding structure according to a further embodiment.

In case of the antenna 80, radiating bodies 82*a* and 82*b* are separated from a feeding structure 800.

That is, though the radiating bodies 82*a* and 82*b* are separated from the feeding structure 800, one of the radiating bodies 82*a* and 82*b* and a radiating body loop 84 connected to the radiating bodies 82*a* and 82*b* are coupled with the feeding structure 800 by a magnetic flux generated from the feeding structure 800. Accordingly, the feeding structure 800 may feed an RF signal to the radiating bodies 82*a* and 82*b* in an electromagnetic way.

The feeding structure 800 of the antenna 80 includes a first loop 810 formed including a feeding part 81 and a reactance device 83, a second loop 820 formed including the reactance device 83 and a conductive line, and a third loop 830 formed including the feeding part 81 and a conductive line.

The feeding structure 800 according to the present embodiment includes the third loop 830 corresponding to a low frequency loop, the second loop 82 corresponding to an intermediate frequency loop, and the first loop 810 corresponding to a high frequency loop, in which a resonance frequency is generally determined by an area of the second loop 820 and a reactance of the reactance device 83.

The above description relates to a feeding structure for more efficiently feeding an RF signal inputted from a feeding part to a radiating body in an antenna structure including the feeding part and the radiating body. Accordingly, in the description, the feeding part includes a matching circuit for impedance matching with a feeding source. For example, when connecting a reactance device for impedance matching to a feeding source, in this case, the feeding source and the reactance device may be included in a feeding part.

Figure 9:
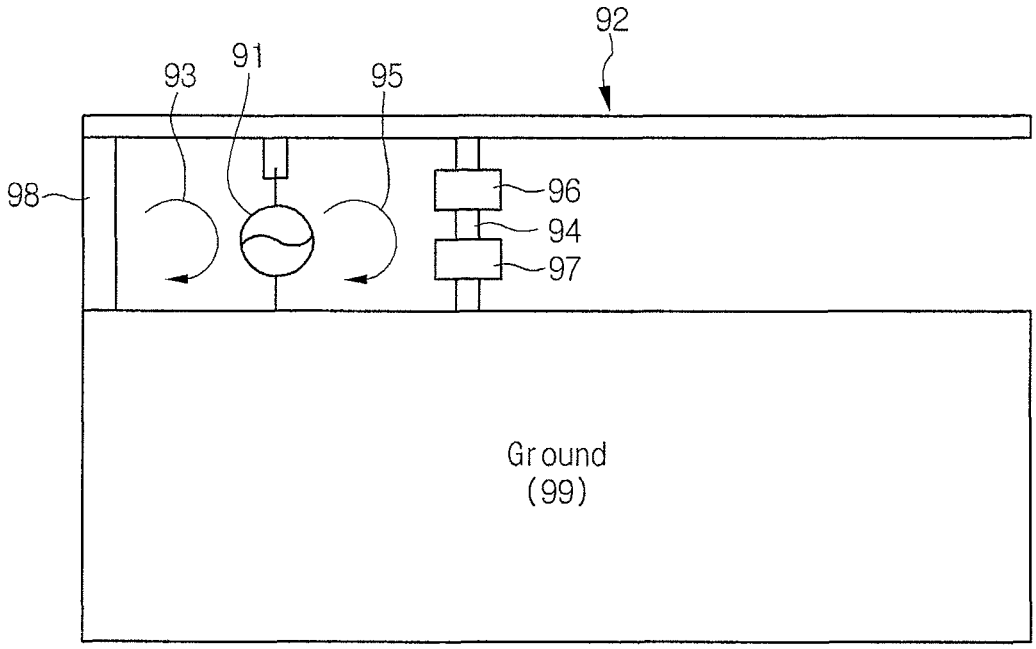
FIG. 9 is a view illustrating an antenna with a feeding structure according to another embodiment, in which a plurality of reactance devices are connected in series.

FIG. 9 is a view illustrating an antenna with a feeding structure according to another embodiment, in which a plurality of reactance devices are connected in series.

Figure 10:
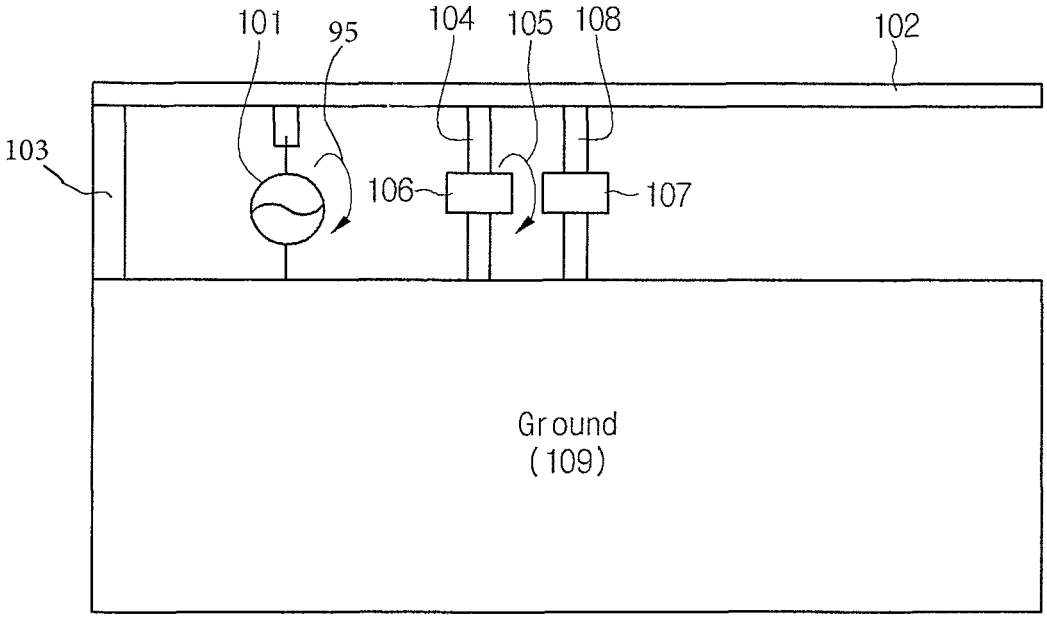
FIG. 10 is a view illustrating an antenna with a feeding structure, in which circuits including one or more reactance devices are connected in parallel.

FIG. 10 is a view illustrating an antenna with a feeding structure according to another embodiment, in which circuits including one or more reactance devices are connected in parallel.

As shown in FIG. 9, in a radiating body 92 and feeding structure, a grounding part 98 including a ground 99 is connected to a feeding part 91 and forms a first loop 93 and a second loop 94 is formed by a resonance addition part 94 including a plurality of reactance devices 96 and 97 connected to the feeding part 91, thereby emitting an RF signal in a certain frequency band.

Also, as shown in FIG. 10, a plurality of resonance addition parts 104 and 108 are connected to a feeding part 101 and a grounding part 103 including a ground 109 and form a second loop 105. One or more reactance elements 106 and 107 of the resonance addition parts 104 and 108 are connected to the feeding part 101 in parallel. Via the second loop 105, the RF signal with a certain frequency band is emitted.

In the present embodiment, a reactance device may be connected to the grounding part 98, 109 through grounds 99, 109 or a feeding line where the feeding part 91, 101 is connected to, in which the reactance device may be connected to the resonance addition parts 94, 104, and 108 to properly provide characteristic thereof.

The present embodiment relates to controlling a frequency by adding the reactance devices to the resonance addition parts 104 and 108 for providing a broadband in addition to the grounding part, in which the resonance addition parts 104 and 108 may be connected to the grounding part in parallel to provide various reactance values needed in a resonance frequency.

The resonance addition parts are connected in parallel, one or more reactance devices are connected to the resonance addition parts, respectively, and the reactance devices are connected in series when a plurality of the reactance devices are connected to one of resonance addition parts.

In the present embodiment, an inductance L is formed by the s resonance addition part additionally connected, thereby connecting capacitance values providing a resonance point in series/parallel to derive a value obtaining values 0.254 pF, 0.374 pF, 0.343 pF, 12.5 pF, etc., which have not released yet as goods.

As shown in FIG. 10, a plurality of the resonance addition part 104 and 108 including one or more reactance devices 106 and 107 are connected to one another in parallel.

As described above, the reactance devices are connected in series or in parallel, adding-up characteristics of the reactance devices are applied, the plurality of reactance devices 96, 97, 106, and 107 are controlled, and a reactance value not standardized when forming a resonance may be derived, thereby minutely controlling a loop.

Typically, in an antenna structure, a low reactance value (0.3 to 1.5 pF) is used for a frequency of 1800 MHz or more used in a device such as PCS and a high reactance value (6 to 9 pF) is used for a frequency of 960 MHz or less.

Though, currently, products standardized with a low reactance (2 pF) exist by 0.1 pF unit and products standardized with a high reactance (6 pF or more) exist by 1 pF unit, since a structure is more sensitive than a standardized tolerance of a reactance device, there is needed a reactance value not standardized when forming a resonance with a desired frequency.

Accordingly, as described with respect to the embodiments, based on FIGS. 9 and 10, a reactance value for resonance via various embodiments (refer to FIGS. 11 to 16) may be derived.

Calculation characteristics of reactance values according to connection in series/in parallel of reactance devices are expressed as follow.

$$C_total = C1C2/C1+C2 \quad \text{Equation (10)}$$

$$C_total = C3+C4 \quad \text{Equation (11)}$$

To form a proper reactance with respect thereto, a reactance not standardized may be derived by using serial/parallel characteristics of reactance devices.

As an example, when a resonance is formed with a desired frequency of 0.343 pF, C_total: 0.343 pF may be derived by connecting C1=2.4 pF/C2=0.4 pF in parallel.

As another example, when a resonance is formed with a desired frequency of 12.5 pF, C_total: 12.5 pF may be derived by connecting C3=12 pF/C4=0.5 pF in parallel.

FIGS. 11 to 16 are views illustrating examples of variously connecting reactance devices.

Figure 11:
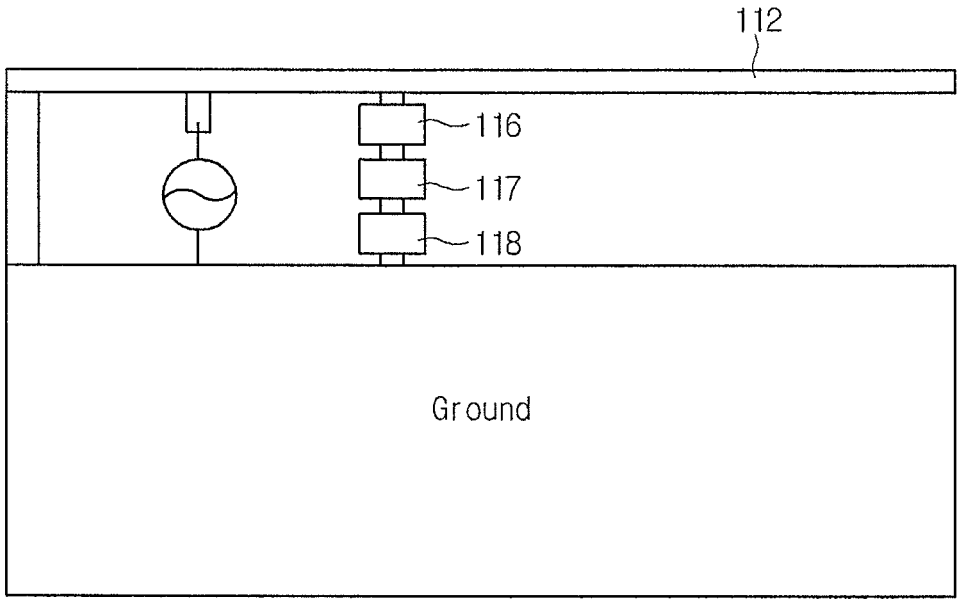
FIG. 11 is a view illustrating an example in which three reactance devices are connected in series is connected to a resonance addition part.

FIG. 11 is a view illustrating an example in which three reactance devices 116, 117, and 118 are connected in series is connected to a resonance addition part 114.

Figure 12:
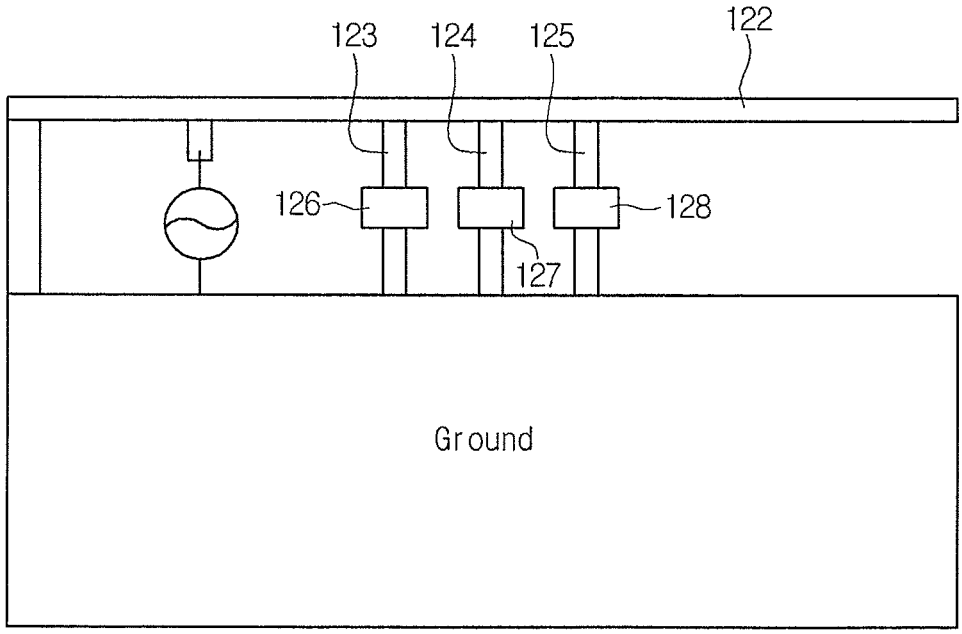
FIG. 12 is a view illustrating an example in which one or more reactance devices are connected to a plurality of resonance addition parts, respectively.

FIG. 12 is a view illustrating an example in which one or more reactance devices are connected to a plurality of resonance addition parts 123, 124, and 125, respectively, the respective resonance addition parts 123, 124, and 125 being connected in parallel, that is, the respective reactance devices being connected in parallel.

Figure 13:
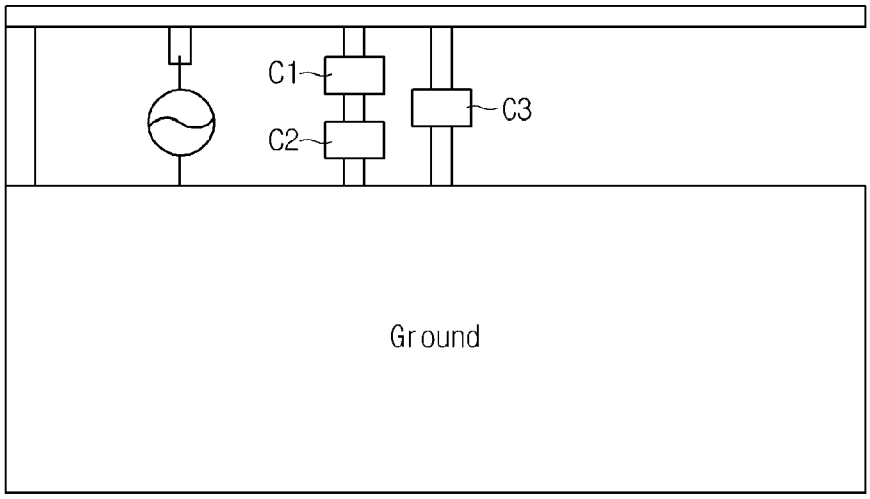
FIG. 13 is a view illustrating an example in which one or more reactance devices are connected to a plurality of resonance addition parts, respectively.

FIG. 13 is a view illustrating an example in which one or more reactance devices are connected to a plurality of resonance addition parts, respectively, the resonance addition parts being connected in parallel, a plurality of reactance devices being connected, particularly, to any one of the resonance addition parts in series.

Figure 14:
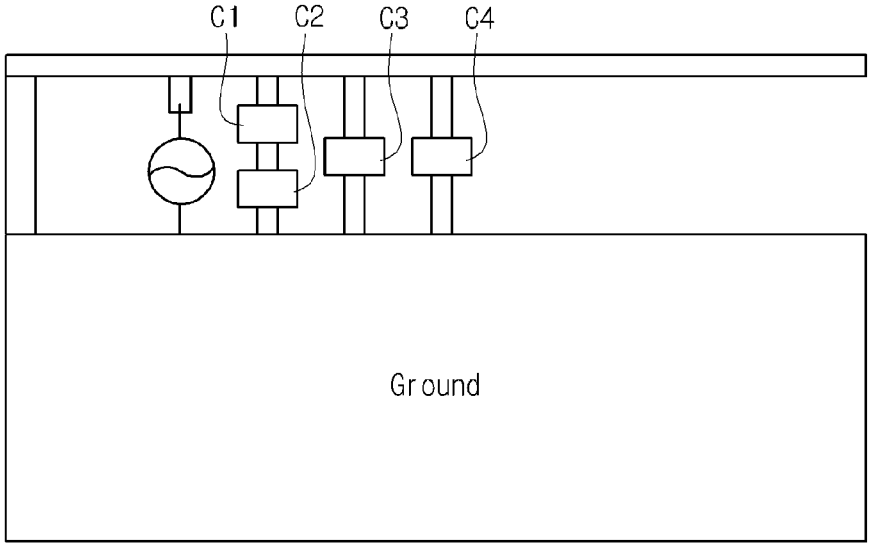
FIG. 14 is a view illustrating an example in which one or more reactance devices are connected to a plurality of resonance addition parts, respectively.

FIG. 14 is a view illustrating an example in which one or more reactance devices are connected to a plurality of resonance addition parts, respectively, the resonance addition parts being connected in parallel, a plurality of reactance devices being connected, particularly, to any one of the resonance addition parts in series.

Figure 15:
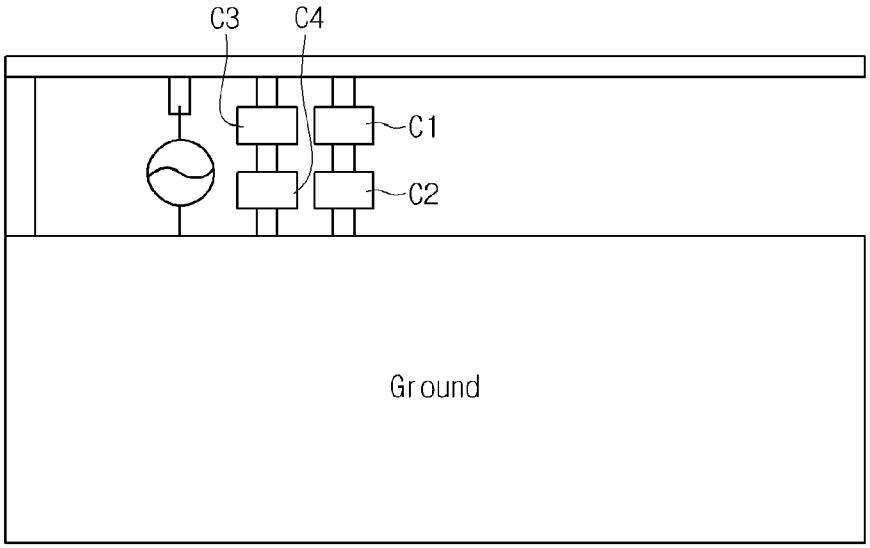
FIG. 15 is a view illustrating an example in which two or more reactance devices are connected to a plurality of resonance addition parts, respectively.

FIG. 15 is a view illustrating an example in which two or more reactance devices are connected to a plurality of resonance addition parts, respectively, the resonance addition parts being connected in parallel.

Figure 16:
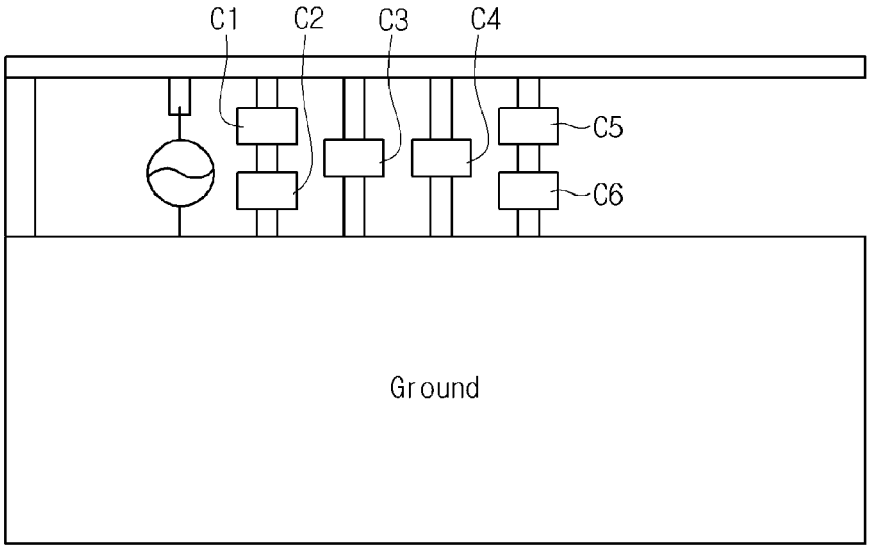
FIG. 16 is a view illustrating an example in which a plurality of reactance devices are connected to two of resonance addition parts in series and one or more reactance devices are connected to two others, the resonance addition parts being connected in parallel.

FIG. 16 is a view illustrating an example in which a plurality of reactance devices are connected to two of resonance addition parts in series and one or more reactance devices are connected to two others, the resonance addition parts being connected in parallel.

Each of the examples of connections as described above may correspond to every single embodiment, and it is possible to provide various embodiments from connecting the plural in series.

Figure 17:
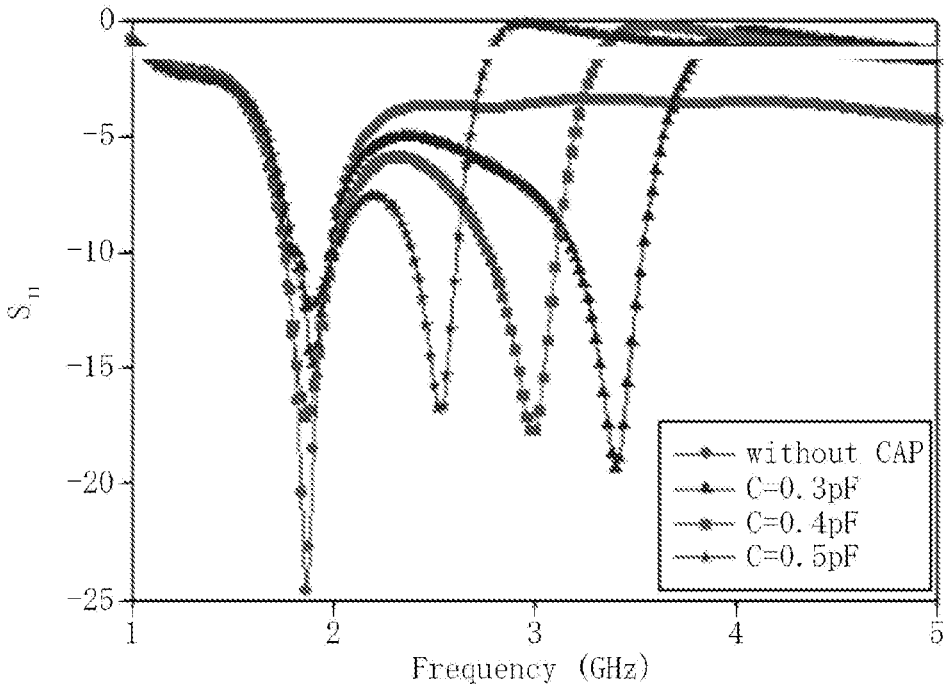
FIG. 17 is a view illustrating characteristics of an antenna using standardized reactance devices.

FIG. 17 is a view illustrating characteristics of an antenna using standardized reactance devices.

Figure 18:
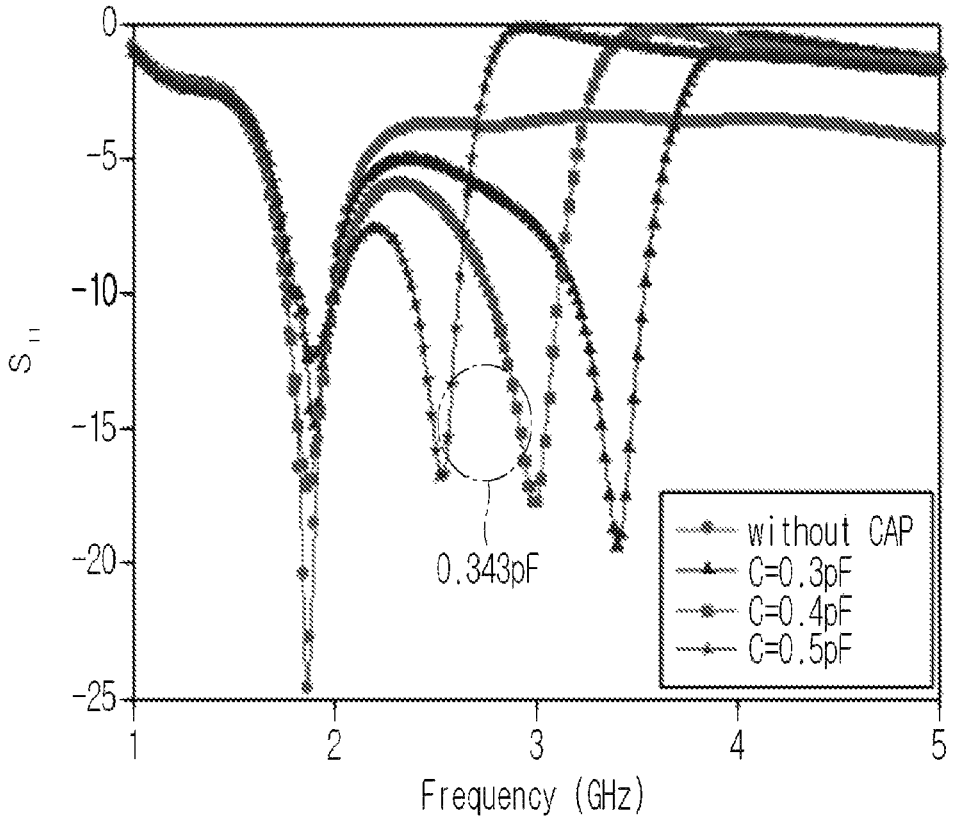
FIG. 18 is a view illustrating characteristics of an antenna using reactance devices not standardized.

FIG. 18 is a view illustrating characteristics of an antenna using reactance devices not standardized.

As described above, at least one reactance device is added to at least one resonance addition part, in addition to a grounding part, to control a frequency, in which a plurality of reactance devices are connected in series or in parallel, thereby providing various reactance values needed in resonance frequencies.

The present embodiment as described above may be applied to all antennas for controlling frequencies by using capacitances.

According to the present embodiment, when a reactance value for a resonance frequency of an antenna is not a quantified value, an optimal reactance device value needed in a resonance may be derived by using a plurality of parallel or serial reactance devices to minutely adjust the reactance value.

Related to broadband antennas, an optimal reactance value to allow a resonance to occur at a desired frequency may be determined by coupling a plurality of parallel or serial reactance devices.

Accordingly, in accordance with the circuit configuration, it is possible to select and use a proper reactance device for a resonance reactance, that is, it is possible to control antenna polarization with a desired frequency band by obtaining a reactance value not standardized.

Also, it is possible to tune an antenna by using only reactance devices without variances in sizes of loops on design, thereby simplifying a tuning method.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An antenna apparatus, comprising:

a radiating body;

a feeding part for providing a signal for the radiating body and connected to the radiating body;

a grounding part for grounding the radiating body and extended from the radiating body;

a resonance addition part disposed between the feeding part and the grounding part; and a ground body connected to the grounding part and the resonance addition part, wherein the resonance addition part comprises at least one reactance device, wherein the reactance device comprises at least one of a capacitive device and an inductive device, wherein the reactance device is connected to the feeding part and the grounding part in parallel, wherein a first loop is formed by the feeding part and the resonance addition part and generates a first magnetic flux in a first frequency band, wherein a second loop is formed by the resonance addition part and the grounding part and generates a second magnetic flux in a second frequency range, wherein a third loop is formed by the feeding part and the grounding part and generates a third magnetic flux in a third frequency range, and wherein, in the second frequency range, a resonance is generated due to an inductance provided by the second loop and a reactance provided by the at least one reactance device such that the second magnetic flux mainly excites the radiating body.

2. The antenna apparatus of claim 1, wherein the inductive device is an inductor.

3. The antenna apparatus of claim 1, wherein the first frequency range is higher than the second frequency range, and the second frequency range is higher than the third frequency range, wherein in the third frequency range, an impedance of the first loop increases, a current mainly flows toward the third loop such that the third magnetic flux generated by the third loop mainly excites the radiating body, and wherein in the first frequency range, an impedance of the third loop increases, a current mainly flows toward the first loop such that the first magnetic flux generated by the first loop mainly excites the radiating body.

* * * * *